US005595167A

United States Patent [19]

Scott

[11] Patent Number: 5,595,167

[45] Date of Patent: Jan. 21, 1997

[54] SECURE ARCHERY WRIST STRAP

[76] Inventor: John W. Scott, 587 Adams Ridge Rd., Clay City, Ky. 40312

[21] Appl. No.: 486,696

[22] Filed: Jun. 7, 1995

[51] Int. Cl.[6] ..... F41B 5/18

[52] U.S. Cl. ..... 124/35.2; 124/1

[58] Field of Search ..... 124/35.2, 1

[56] References Cited

U.S. PATENT DOCUMENTS

| | | | |
|---|---|---|---|
| 4,509,497 | 4/1985 | Garvison | 124/35.2 |
| 4,831,997 | 5/1989 | Greene | 124/35.2 |
| 4,909,232 | 3/1990 | Carella | 124/35.2 |
| 5,224,463 | 7/1993 | Townsend | 124/35.2 |
| 5,261,581 | 11/1993 | Harden, Sr. | 224/219 |
| 5,323,754 | 6/1994 | Pittman et al. | 124/35.2 |
| 5,357,939 | 11/1994 | Tentler et al. | 124/35.2 |

*Primary Examiner*—John A. Ricci
*Attorney, Agent, or Firm*—Laurence R. Letson

[57] ABSTRACT

A wrist strap for an archery bowstring release has the two ends of the strap closed and attached to each other by hook and loop type fastening material. A separate web, having hooks and loops on opposite faces over a substantial porion of the web and hooks on the remainder of the surface of the web which has loops extending from the loop region to the distal end of the web, then may be wrapped around the user's wrist. The hooks on the web engage the mating loops on the outer or top surface of one of the branches of the wrist strap to insure that the first end of the wrist strap remains firmly engaged with the second end of the wrist strap. Thereafter, the web is threaded through a ring which permits the web to be doubled back over itself and the hooks on the distal portion of the web engage with the loops on the outer exposed surface of the exposed wrap of the web, thereby insuring engagement to retain the wrist strap on the wrist of the user and to prevent inadvertent separation of the two branches of the wrist strap or other inadvertent separation of the wrist strap from the archer's wrist, providing a triple closure and locking engagement of the components.

15 Claims, 3 Drawing Sheets

SECURE ARCHERY WRIST STRAP

FIELD OF THE INVENTION

This invention relates to archery bowstring release wrist straps and more particularly to insuring that whenever under load the wrist strap remains securely attached to the archer's wrist.

BACKGROUND OF THE INVENTION

Bowstrings of compound bows have pulls in the order of 80 to 120 lbs (356–534 N). As an archery bowstring release is used by the archer, substantial forces are exerted on the release by the bowstring.

The use of wrist straps has become common to accommodate these large forces which have the potential to cause possible injury to the archer's fingers. A wrist strap spreads the force of the bow string over a relatively large surface area of the wrist and the back of the archer's hand while leaving at least the thumb or index finger of the hand free to activate or fire the trigger of the bowstring release.

Wrist straps have been closed onto and attached to the wrist of the user by buckles such as is disclosed in U.S. Pat. No. 5,261,463 to Ralph E. Harden, Sr., or hook and loop fasteners as disclosed in U.S. Pat. No. 4,831,997 to James H. Greene and U.S. Pat. No. 5,323,751 to Johnny Pittman et al. The hook and loop fasteners engage facing surfaces of the wrist strap ends and are overlaid one on the other and forcibly pressed together to engage the hooks and loops to provide the fastening function.

Buckles, while providing positive attachment, are awkward and generally only provide adjustments in fixed increments. The use of the buckle is more difficult than hook and loop fasteners because the typically right handed archer will be using the left hand to buckle the wrist strap about his wrist, a manual operation which a person would normally use two hands to accomplish if possible. Depending upon the spacing of the holes which the buckle keeper engages, the strap may be either too loose or too tight for comfort, and/or for reliability on the archer's wrist.

The incorporation of the hook and loop fasteners into a wrist strap provides increased comfort, ease of attachment, and infinite adjustment of the wrist strap size over a substantial range. The use of the hook and loop fasteners also tends to eliminate the need to manufacture and stock multiple sizes of the wrist strap and thus can accommodate a generally wider spectrum of wrist sizes.

However, a significant drawback in the use of the hook and loop fasteners to attach the two distal ends of the archery bowstring wrist strap is in the loading of the strap by pulling on the bowstring. The hooks of the wrist strap may not fully retain engagement with loops of the hook and loop fastener. This may be due to several reasons including partial straightening of the hooks from extended use, a failure to fully and properly engage the hooks and loops, or the placement of the hook and loop fasteners in an orientation whereby the force of the bowstring causes a peeling action and thus peels the fastener apart, releasing the strap.

Further, for those users having a large circumference wrist, the surface area of engagement of the hook and loop fastener may be reduced to the point that the hook and loop fasteners may become ineffective under load and release the strap.

If the wrist strap separates under load, the result either can be a misdirected shot which may or may not be of serious consequence or a possible injury to the archer by virtue of the fact that the bowstring will pull the wrist strap from the wrist and the strap and release will flail about as the bowstring stops its forward motion. Since the archer's other hand and arm are disposed in an area close to the path of bowstring movement, the wrist strap and/or the bowstring release may strike the archer's arm or other hand. An extremely high velocity and the force of an 80–120 lb pull bow could seriously injure the archer's hand or arm.

OBJECTS OF THE INVENTION

It is an object of the invention to insure continued engagement of the hook and loop fasteners on archery release wrist straps.

It is an additional object of the invention to distribute the forces that insure continued engagement of the fasteners over points close to the attachment point of the archery release to the wrist strap.

It is another object of the invention to improve the reliability of the closure of the archery bowstring release wrist strap.

It is a further object of the invention to improve the archer's confidence, in the equipment thereby improving the archer's accuracy.

SUMMARY OF THE INVENTION

The shortcomings of the prior art are overcome and the objects of the invention are accomplished by the subject invention. In summary, a wrist strap is provided of flexible material conformable to the archer's wrist in the form of "V" with two branches, each joined at the apex of the "V". The branches of the strap conform to the wrist of the user with the apex of the strap disposed either over the heel of the hand or in the palm of the hand of the archer. The "V" shape of the strap permits the wrapping about the wrist in such a way that the two free ends will overlap and engage with each other to hold the strap on the wrist. The distal ends of the branches of the wrist strap are provided with a hook and loop fastener disposed between the overlapping branch ends. One end is provided with loop portion of the hook and loop fastener material, and the other end is provided with the hook portion of the hook and loop fastener material.

In order to improve the closure of the strap and to insure that the strap remains closed around and attached to the wrist, a web is attached to the strap near the apex and is provided with hooks on the underside over only a portion of the web length. On the top side of the web extending over the region of hooks on the underside, the web supports a loop portion of the hook and loop fastener material. On the remainder of the web topside extending from the loop portion to the distal end of the web, there are disposed a plurality of hooks forming the hook portion of the hook and loop fastener material.

The other branch, which does not have the web attached thereto, has the loop portion of the hook and loop fastener material on the top surface proximate to the distal end thereof.

A ring, preferably of a rectangular shape, is attached to the branch of the strap having the loop portion of the hook and loop fastener disposed on its distal end. The rectangular ring may be attached with a web which is threaded through the ring and thereafter is threaded through an aperture in a pull ring. The web then is sewn to the strap with the pull ring proximate the wrist strap apex and the ring disposed between the apex and the distal end of the branch. The pull ring is further attached to the strap by the web which is threaded through the plate aperture, folded back on itself, and sewn to the strap.

The web may be passed over the closed ends of the wrist strap as disposed about the wrist of the archer and the hooks on the web underside may be engaged with the loops on the top surface of the wrist strap branch. The web is threaded further through the ring and folded back on itself and the mating hooks and loops engaged to retain the web in a snug, folded back, engaged condition. While not as strong as the strap, the web acts as a constraint to prevent the closure of the wrist strap ends from parting, thereby maintaining closure of the wrist strap under load. The web is effective to prevent any potential peeling action described above and to partially relieve some of the forces which may cause the hook and loop fastener to separate, due to the deformation of the hooks over time and/or and from extensive usage.

The hooks on the web underside and the loops on the wrist strap topside when engaged together provide a fastening force which further resists separation of the ends of the wrist strap, which is additive to compressive force of the web overlying the wrist strap closure. Therefore, the web may absorb a significant portion of the loading, thus permitting division of the load and maintaining the use of the load on the web to insure fastening engagement.

A more complete and detailed understanding of the invention may be had from the detailed description of the invention together with the attached drawings which follows.

DETAILED DESCRIPTION OF THE PREFERRED EMBODIMENT OF THE BEST MODE CONTEMPLATED BY THE INVENTOR FOR CARRYING OUT THE INVENTION

Figure 1:
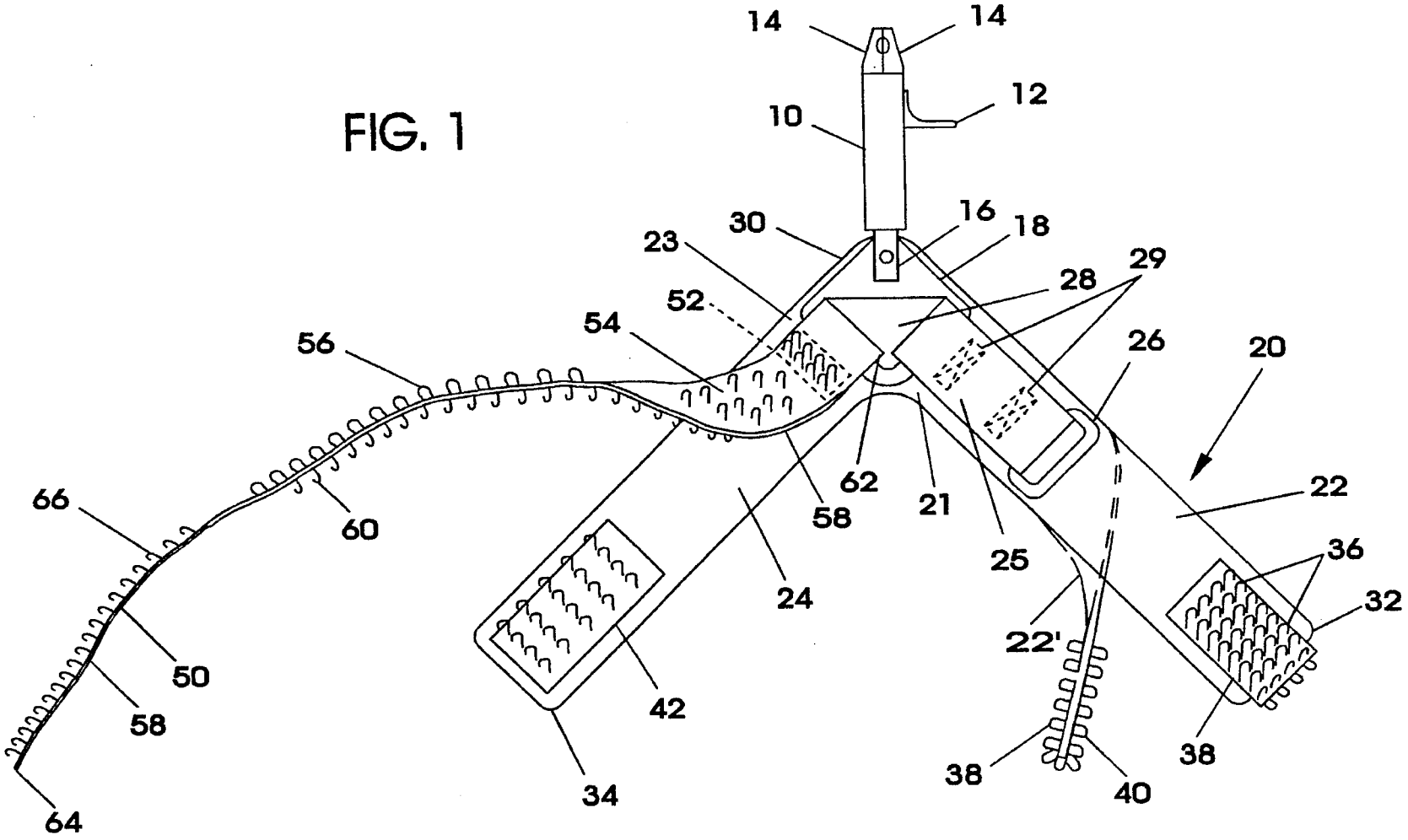
FIG. 1 is a plan view of the wrist strap and archery bowstring release laid flat for illustration with portions warped for visibility.

Referring initially to FIG. 1, an archery release 10 having a trigger 12 and bowstring engaging jaws 14 is attached through a shaft 16 to a pull ring 18. A wrist strap 20 is formed of a flexible material, preferably leather or a strong nylon fabric, into a "V" shaped arrangement having a first branch 22 and a second branch 24. The first branch 22 is also illustrated at 22' in a warped or deflected dashed line position for illustrative purposes.

A web of material 25 such as nylon strapping is used to attach rectangular or "D"-shaped ring 26 to the first branch 22 of wrist strap 20. The nylon strap 25 may be advantageously looped through the aperture 28 of pull ring 18 for purposes of attaching pull ring 18 to the wrist strap 20. After the web 25 has been inserted through the aperture 28 and into ring 26, it may be folded back and placed over the wrist strap 20 and stitched to the wrist strap 20 at regions 29.

Each branch 22 and 24 of wrist strap 20 has two ends; proximal end 21 of branch 22 which is joined to the proximal end 23 of branch 24 together form the junction or apex 30 of strap 20 along with and distal end 32 and 34 on branches 22 and 24, respectively. Distal end 32 of branch 22 is further provided with a plurality of loops 36 as a part of a loop portion 38 of a hook and loop fastener material. The distal end 32 of branch 22 supports the loop portion 38 on its topside and a similar loop portion 40 on its underside. For ease of manufacturing, a single swatch of loop material may be folded over the distal end 32 and stitched to the branch 22 of wrist strap 20.

Referring now to branch 24, a portion or swatch of the hook portion 42 of hook and loop fastener material is disposed on and attached to distal end 34 of branch 24. The swatch of hook material 42 may be glued, cemented, otherwise bonded, or sewn onto the top surface of branch 24 near the distal end 34.

To complete the attachment of pull ring 18 to the wrist strap 20, an elongated web 50 is looped through aperture 28 in pull ring 18 and is attached to branch 24 of wrist strap 20 at the attachment zone 52. The technique of attachment preferably is sewing or stitching.

Web 50 is provided on its topside 54 with an area adjacent the proximal end 62 of web 50 having loops 56 which are part of a hook and loop fastening device. The underside 58 of web 50 is provided with a region having a plurality of hooks 60 which is substantially coextensive with, but on the opposite side of, web 50 from loops 56. With the proximal end 62 of web 50 attached to branch 24 at attachment region 52, the distal end 64 of web 50 extends beyond the region of loops 56 and hooks 60. The portion 48 of web 50 between hooks 56 and hooks 60 and the distal end 64 is provided with a region of hooks 66 on the top surface 54 of web 50 while the underside 58 of web 50 is left without either hooks or loops.

If desired, the particular arrangements of the regions of hooks and loops and particularly the loops in regions 38, 40, 56, and the hooks in regions 42, 60, and 66 may be fabricated with the other attaching loop or hook in that region. For example, if desired, the hooks in regions 66 and 42 may be replaced with loops and the loops in regions 38, 40, and 56 may be replaced with hooks. Nevertheless, the arrangement illustrated in FIG. 1 is the preferred embodiment of the best mode.

Figure 3:
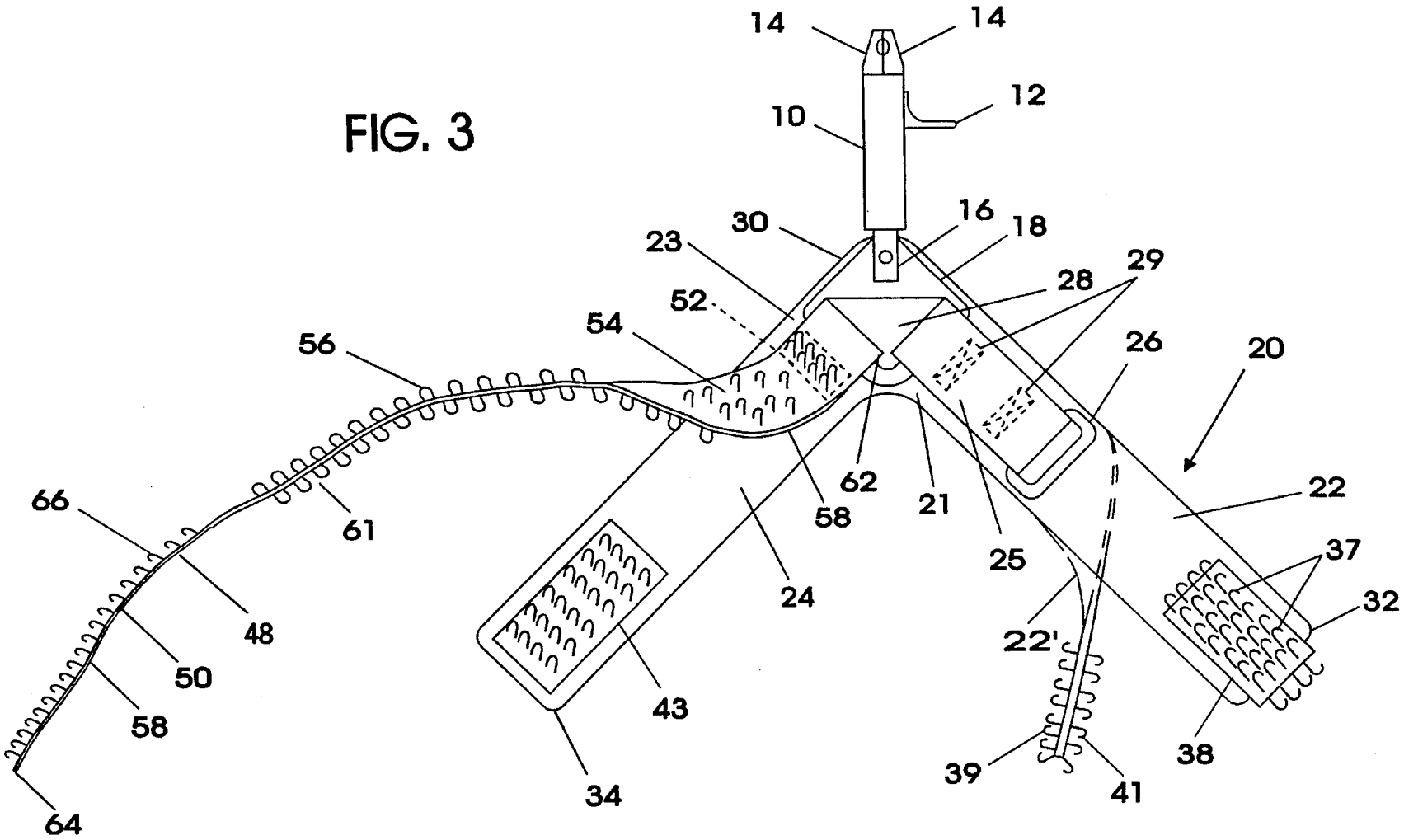
FIG. 3 is an illustration of a wrist strap as shown in FIG. 1 with selected regions of hooks and regions of loops changed to loops and hooks.

An alternate embodiment having the hook and loop arrangement reversed is shown in FIG. 3. Distal end 32 of branch 22 is further provided with a plurality of hooks 37 as a part of a hook portion 39 of a hook and loop fastener material. The distal end 32 of branch 22 supports the hook portion 39 on its topside and a similar hook portion 41 on its underside.

Referring now to branch 24, a portion or swatch of the loop portion 43 of hook and loop fastener material is disposed on and attached to distal end 34 of branch 24.

Web 50 is provided on its topside 54 with an area adjacent the proximal end 62 of web 50 having loops 56 which are part of a hook and loop fastening device. The underside 58 of web 50 is provided with a region having a plurality of loops 61 but on the opposite side of, web 50 from loops 56.

Figure 2:
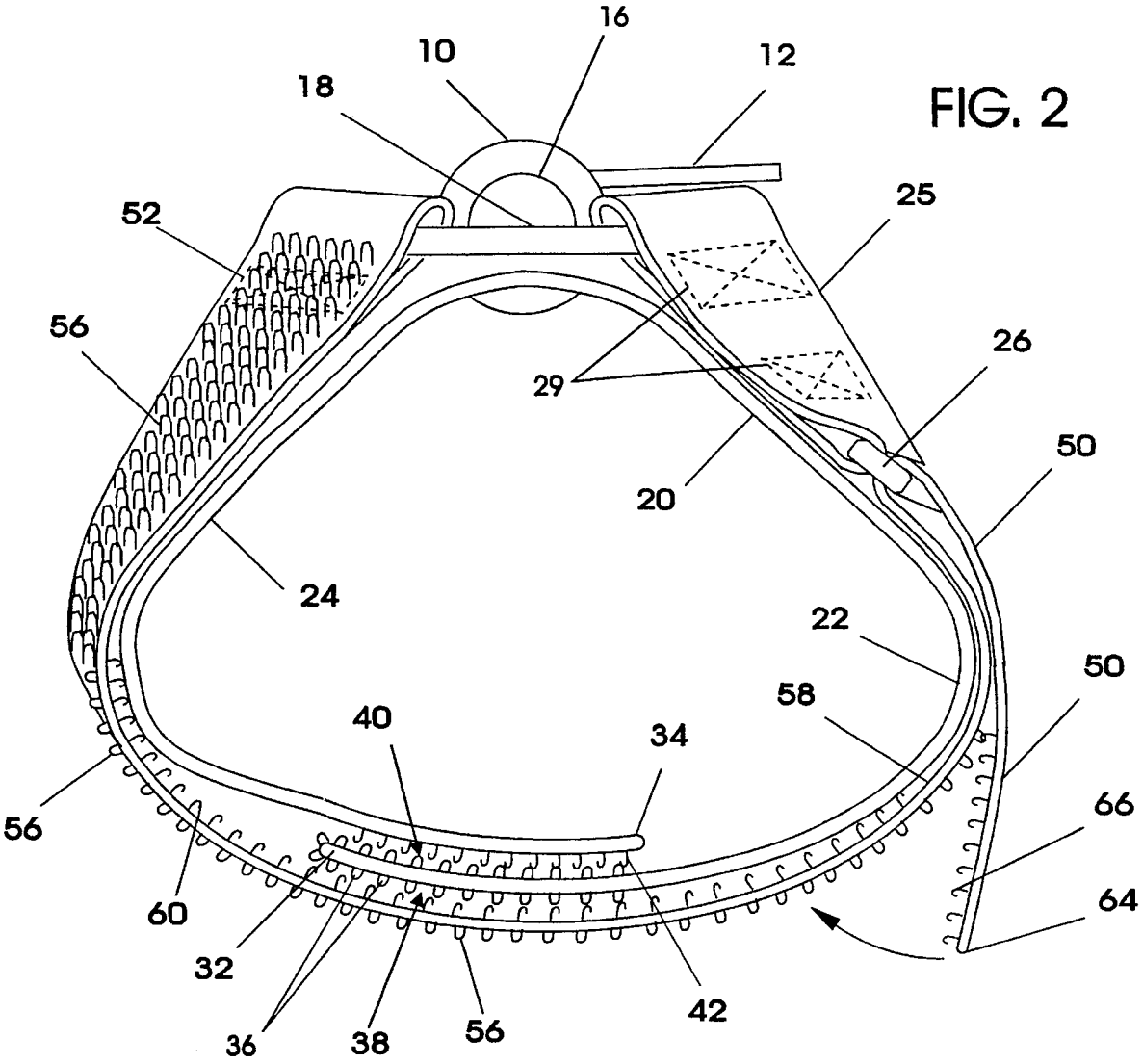
FIG. 2 is a view of the wrist strap closed as if disposed on an archer's wrist.

FIG. 2 illustrates the bowstring release 10, with trigger 12, attached to and extending away from pull ring 18. Pull ring 18 is attached by means of web 25 to the wrist strap 20 and particularly to branch 22 of the wrist strap 20. Wrist strap branches 22 and 24 are wrapped around either wrist, left or right, of the user with the distal end 34 of branch 24 innermost against the wrist (not shown) of the user. The distal end 32 of branch 22 then is wrapped and overlapped over branch 24 to engage the hooks 42 resident on branch 24 with the loop material 40 resident on the underside of branch 22. The hook and loop materials 42, 40 are forcibly engaged with each other to seal the two distal ends 34 and 32 together and to retain wrist strap 20 disposed around the user's wrist.

Thereafter, web 50 is wrapped around the user's wrist and conforms with and overlaps the loops 36 on the top side of branch 22 so that the hooks 60 on the underside 58 of web 50 will engage with loops 38. This action will tend to prevent the hook material 42 and loop material 40 from disengaging from themselves as well as to provide a secondary fastening. Web 50 is further wrapped around the user's wrist and threaded through the rectangular ring 26 and then wrapped back over the web 50 such that the hooks 66 on the top surface 54 (now inner surface of web 50) are engaged with the loops 56 which also reside on the same surface 54 of web 50 as the hooks 66. The engagement of loops 56 and hooks 66 form a triple lock or fastening. The web 50 thus being retained in its wrapped and engaged condition will insure that the distal end 32 of branch 22 will be snugly retained in face-to-face engaging condition with the distal end 34 of branch 24. The web 50, being snugly wrapped and retained and not necessarily carrying the bulk of the forces exerted by the bowstring of a bow onto release 10 and pull ring 18, will act to insure that branch 22 remains overlapped and engaged with branch 24 of the wrist strap 20.

Inadvertent peeling of the connection or engagement between hooks 42 and loops 36 is prevented by fastening together the web 50 and hooks 60, over exposed loops 36 as well as the inward force of web 50 against distal end 32; this fastening will prevent the distal end 32 of branch 22 from being inadvertently peeled from engagement and thereby prevent inadvertent release of distal end 34 of branch 24 from distal end 32 of branch 22. This device provides a triple lock closure of the wrist strap 20: one locking closure exists between loops 40 and hooks 42, a second locking closure between loops 38 and hooks 60, and a third locking closure between loops 56 and hooks 66.

Even with the triple locking closure of the arrangement as illustrated in FIG. 2, archery wrist strap 20 may be easily applied to the wrist and hand of the archer using only his free hand. While this device is described as being worn on the right wrist and hand, it is equally usable and applicable to the left wrist and hand for the left-handed archer.

It should be noted that the release 10 typically is rotationally attached to the shaft 16 and, therefore, the release 10 may be turned 180° to accommodate a left-handed shooter with no other modification necessary.

While the placement of the hook and the loop regions are preferred to be in those regions illustrated in FIGS. 1 and 2, nevertheless, a perfectly workable and usable device is fabricated whenever those hook and loop regions are interchanged. If interchanging occurs, some or all of the regions may be interchanged with the understanding being that the particular engaging hooks and loops must be interchanged while the remainder of hooks and loops that do not engage with other interchanged regions may not be affected and may not need to be interchanged.

Although the web 50 and the web 24 have been illustrated and described as having been sewn to the wrist strap 20, other attachment or bonding techniques may be used as desired such as gluing, cementing, or even riveting.

Similarly, the hook and loop regions which are installed on the distal ends 34 and 32 of branch 24 and branch 22, respectively, may be attached to the flexible and supple material which is used to fabricate the wrist strap branches 22 and 24 using any of several attachment techniques. The fastener portions 38 and 42 may be sewn, glued, heat-bonded, or attached by any other technique with the only requirement being that the fastener portions be affixed to the distal ends of the wrist strap 20 in such a way as to be relatively permanently, and fixedly attached to the leather or other material making up the wrist strap 20.

In the description of the secure wrist strap, reference has been made to the archer's wrist, but it should be understood that the strap may placed around an archer's arm or may be positioned around the archer's hand if the strap is not tightened sufficiently to maintain the strap around the wrist.

While this invention has been described with reference to a preferred embodiment a person skilled in the art will recognize that modifications, changes, or deviations in form and detail may be made in the fabrication of this device without removing it from the scope of the claims which are attached hereto and define the invention.

I claim:

1. An archery release wrist strap comprising:

a strap having two branches of flexible material joined into a "V" shape at the proximal ends of said branches with an angle between said two branches of said strap, each said branch having an inner and an outer surface;

a first ring of rigid material, said first ring including an aperture for attaching said first ring to said strap;

a first flexible web of material looped through said first ring and attached to said strap on a first of said branches;

a second ring attached to said strap on said first said branch;

a region on a distal end of said first said branch and on both surfaces thereof covered with a loop portion of a hook and loop fastening material;

said first ring further attached to said strap on said second of said branches;

a second elongated web having a first surface and a second surface, said first surface having a plurality of loops of a hook and loop fastener material on a first region on said second web and a plurality of hooks of a hook and loop fastener material on a second region on said first surface of said second web, said second elongated web further supporting on said second surface a plurality of hooks of said hook and loop fastener material, distal ends of said strap branches supporting hooks and loops of a hook and loop fastener, said distal end of said first branch further provided with loops on said inner surface;

whereby said plurality of loops disposed on said inner surface of said first branch may be engaged with said hooks disposed on said second branch, said strap and said hooks on said second elongated web may be disposed over and engaged with said loops on said outer surface of said first branch of said strap and said second elongated web further disposed extending through said second ring and disposed over a portion of said loops on said first surface of said second elongated web and engaged therewith, thereby reinforcing the fastening forces of said hook and loop fastening material between said branches of said wrist strap.

2. The wrist strap of claim 1 wherein said first ring is attached to said second branch by said second elongated web.

3. The wrist strap of claim 2 wherein said second web is threaded through said first ring and attached to said second branch of said strap.

4. The wrist strap of claim 3 further comprising an archery bowstring release attached to said first ring.

5. The wrist strap of claim 1 wherein said second ring is attached to said first branch by said first web, said first web being fixedly attached to said first branch.

6. The wrist strap of claim 5 wherein said first web is sewn to said first branch.

7. An archery release wrist strap comprising:

a strap having two branches of flexible material joined into a "V" shape at the proximal ends of said branches with an angle between said two branches of said strap; each said branch having an inner and an outer surface;

a first ring of rigid material, said first ring including an aperture for attaching said first ring to said strap;

a first flexible web of material looped through said first ring and attached to said strap on a first of said branches;

a second ring attached to said strap on said first branch;

a region on a distal end of said first branch and on both surfaces thereof covered with a hook portion of a loop and hook fastening material;

said first ring further attached to said strap on said second of said branches;

a second elongated web having a first surface and a second surface, fastener material on a first region on said second web and a plurality of hooks of a loop and hook fastener material on a second region on said first surface of said second web, said second elongated web further supporting on said second surface a plurality of loops of said loop and hook fastener material, distal ends of said strap branches supporting hooks and loops of a hook and loop fastener, said distal end of said first branch further provided with loops on said outer surface;

whereby said plurality of hooks disposed on said first branch may be engaged with said loops disposed on said second branch, said strap and said loops on said second elongated web may be disposed over and engaged with said hooks on said outer surface of said first branch of said strap and said second elongated web disposed extending through said second ring and be disposed over a portion of said hooks on said first surface of said second elongated web and engaged therewith, thereby reinforcing the fastening forces of said loop and hook fastening material between said branches of said wrist strap.

8. The wrist strap of claim 7 wherein said first ring is attached to said second branch by said second elongated web.

9. The wrist strap of claim 8 wherein said second web is threaded through said first ring and attached to said second branch of said strap.

10. The wrist strap of claim 9 further comprising an archery bowstring release attached to said first ring.

11. The wrist strap of claim 7 wherein said second ring is attached to said first branch by said first web, said first web being fixedly attached to said first branch.

12. The wrist strap of claim 11 wherein said first web is sewn to said first branch.

13. An archery bowstring release assembly comprising:

a release mechanism including a release trigger and bowstring release jaws;

an attaching member coupled with said release mechanism and further attached to a wrist strap;

said wrist strap comprising a pair of branches each terminating in a distal end;

said branches and distal ends conformable to an archer's wrist and overlappable to close and attach said wrist strap to form a wrist loop;

a ring attached to said wrist strap on one of said branches;

one of said branches supporting a first region of material of a hook and loop fastener on the outer surface of the distal end thereof, wherein said first region is exposed when said branches are overlapped to form said wrist loop;

a web attached to said wrist strap on the other of said branches and extending therefrom a length to wrap around the user's wrist passing through said ring and folded back and attached to said web, said web supporting a second region of material of a hook and loop fastener complimentary to said first region engaged with and fastened to said first region, whereby the attachment of the two said distal ends is reinforced and prevented from becoming detached during use by being overlayed by said web.

14. The archery release assembly of claim 13 wherein facing surfaces of said branches lap over each other and are joined by said hook and loop fasteners.

15. The archery release assembly of claim 14 wherein said web is attached to itself by said hook and loop fasteners.

* * * * *